United States Patent [19]

Ikeda et al.

[11] Patent Number: 4,551,893

[45] Date of Patent: Nov. 12, 1985

[54] WIRE PROCESSING APPARATUS

[75] Inventors: Yuuji Ikeda, Imajuku; Hiroo Abe, Sangenjaya; Tadashi Osaka, Yokosuka; Katsumi Komuro, Toyoma, all of Japan

[73] Assignee: AMP Incorporated, Harrisburg, Pa.

[21] Appl. No.: 624,435

[22] Filed: Jun. 25, 1984

[30] Foreign Application Priority Data

Jul. 5, 1983 [JP] Japan ..... 58-120971

[51] Int. Cl.[4] ..... H01R 43/04

[52] U.S. Cl. ..... 29/33 M; 29/564.6; 29/564.8; 29/749; 29/754

[58] Field of Search ..... 29/749, 33 M, 564.2, 29/564.6, 564.7, 564.8, 566.1, 753, 754, 564.1

[56] References Cited

U.S. PATENT DOCUMENTS

| | | | |
|---|---|---|---|
| 4,136,440 | 1/1979 | Brandewie et al. | 29/749 |
| 4,253,222 | 3/1981 | Brown et al. | 29/749 |
| 4,333,230 | 6/1982 | Funcik et al. | 29/749 |
| 4,363,167 | 12/1982 | Boutcher, Jr. et al. | 29/749 |
| 4,367,575 | 1/1983 | Forster et al. | 29/749 |
| 4,377,898 | 3/1983 | Hara | 29/564.1 |
| 4,403,407 | 9/1983 | Mazzola | 29/749 |
| 4,409,734 | 10/1983 | Baraglia et al. | 29/749 |
| 4,446,615 | 5/1984 | Talley | 29/753 |

FOREIGN PATENT DOCUMENTS

| | | | |
|---|---|---|---|
| 0037202 | 12/1981 | European Pat. Off. | 29/749 |

*Primary Examiner*—James M. Meister
*Assistant Examiner*—Hien H. Phan
*Attorney, Agent, or Firm*—Jay L. Seitchik

[57] ABSTRACT

Wire processing apparatus comprises first and second wire treatment stations. Wires are fed through the second station and their free ends are terminated to an electrical connector at the first station. Wire lengthening rollers are then operated to advance the wires by different lengths, so that they form loops between the wire treatment stations. During such advance of the wires, wire tensioning rollers are operated to keep the wires in tension between the tensioning rollers and the wire lengthening rollers and to pay out the wires into the loops. The wire lengthening, and the wire tensioning, rollers are then stopped and the wires are simultaneously severed at the second wire treatment station and the severed ends of the leads so formed are terminated to a second electrical connector at the second wire treatment station, after which, the terminated leads are ejected from the apparatus.

8 Claims, 18 Drawing Figures

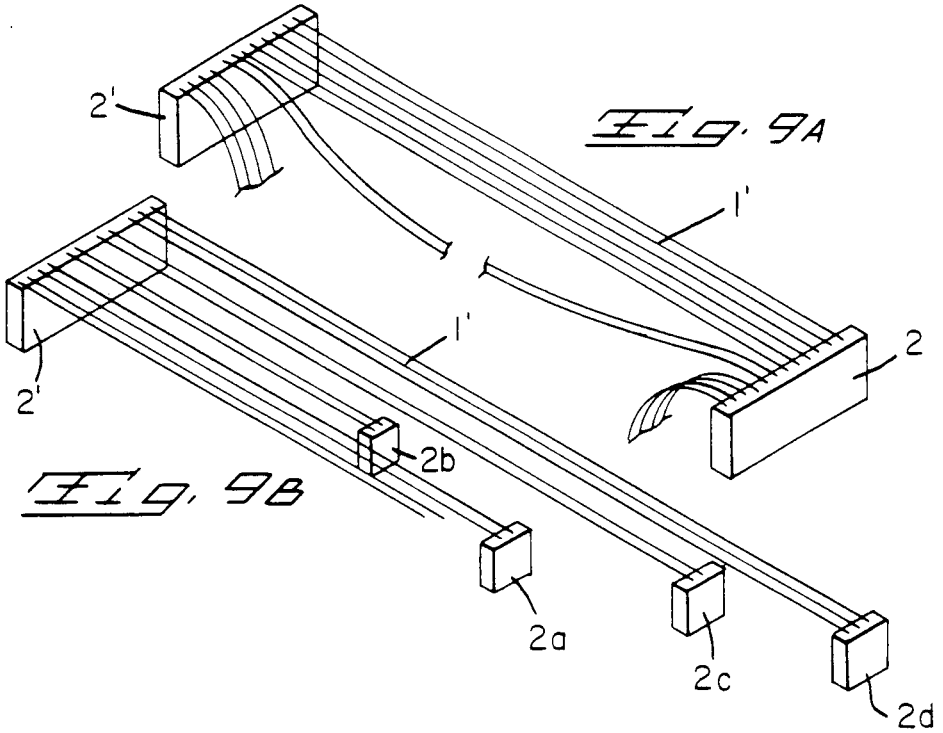
Fig. 9A
Fig. 9B
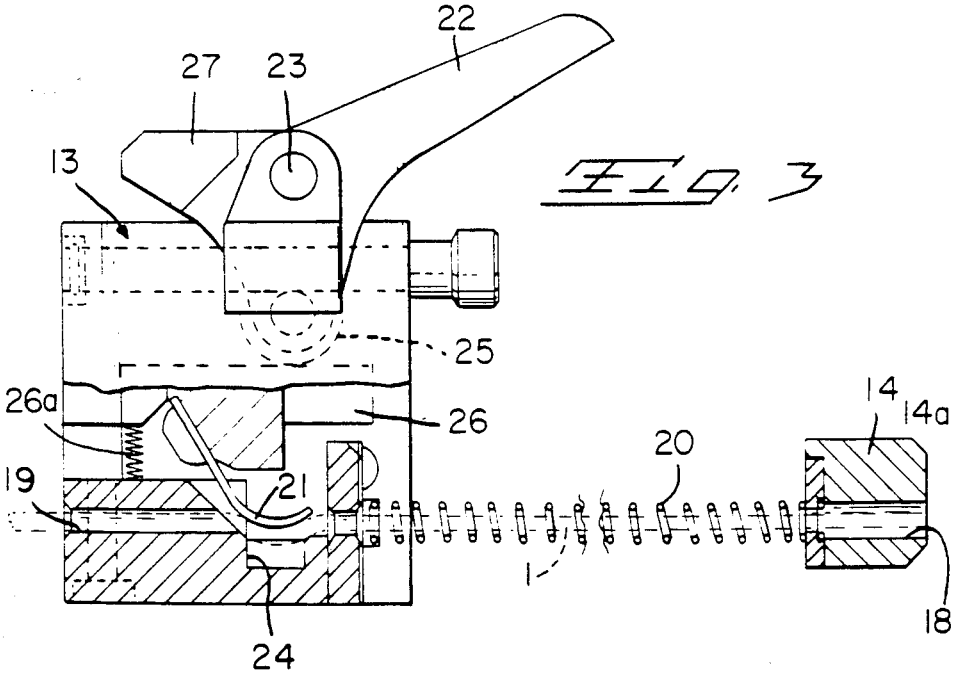
Fig. 3

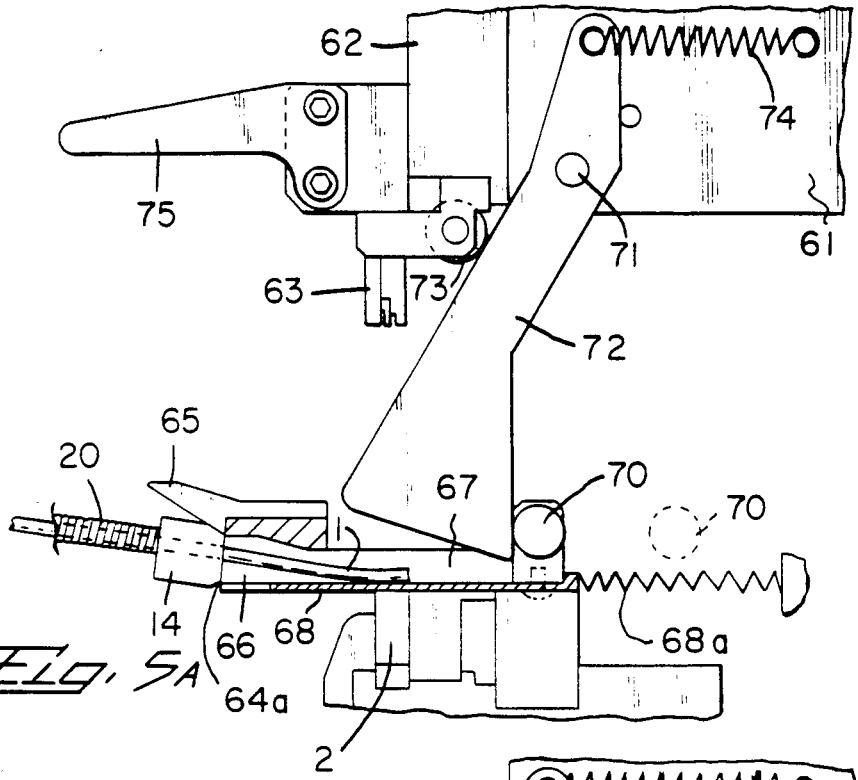
Fig. 5A
Fig. 5B
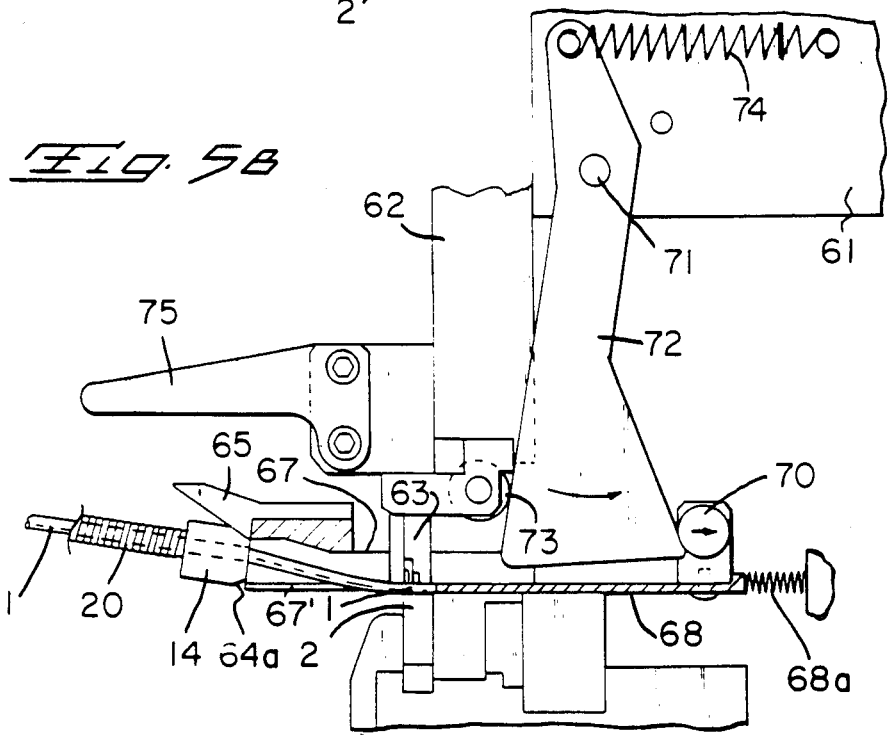

WIRE PROCESSING APPARATUS

This invention relates to wire processing apparatus, in particular to such apparatus which is intended for use in producing electrical harnesses comprising wires of different lengths.

There is disclosed in U.S. Pat. No. 4,380,117, wire processing apparatus comprising a base, first and second wire treatment stations arranged in spaced relationship on the base, a wire delivery shuttle for conveying a plurality of wires in juxtaposed relationship along a wire feed path, through the second to the first station, means for then securing the wires at the first station, means for driving the shuttle in reciprocating motion along said path to deliver the wires to the stations, means for feeding the wires from a wire source for delivery by the shuttle and wire lengthening means disposed upstream of the second station and being actuable axially to advance the wires relative to the shuttle when the wires have been secured at the first station and the shuttle has been retracted from the first station, so that the wires form loops of different lengths between the first and second stations.

It has been found that since the wires must be fed from the wire lengthening means, for a considerable distance through the apparatus before the loops are formed, especially where the wires are thin, the wires tend to buckle between the wire lengthening means and the position at which the loops are formed, whereby the accuracy of the wire lengthening operation is impaired.

According to the present invention, therefore, in wire processing apparatus as defined in the second paragraph of this specification, means disposed downstream of the second station, are provided for paying out the wires as they are advanced by the wire lengthening means, so as to tension the wires between the wire tensioning means and the wire lengthening means.

The wires cannot therefore buckle between the wire lengthening means and the position at which the loops are formed.

Although wire processing apparatus are described in U.S. Pat. No. 3,353,571 and U.S. Pat. No. 4,367,575, in which the wires are lengthened by means of wire lengthening arms which are driven against the wires in a direction perpendicular to their length, and which thereby serve to tension the wires, the wire lengthening operation can more accurately be performed by advancing the wires to different extents axially by means of a wire lengthening device positioned between the wire source and the wire treatment stations.

In the interest of accurate wire measurement, the wire tensioning means preferably comprises sets of rollers which can be closed about the wires to drive them and which comprise both idle rollers and driven rollers, the driven rollers being arranged to slip as soon as the wire lengthening means has been deactuated so that it ceases to advance the wires. The rollers may be provided with means for guiding the wires between them as they are closed about the wires.

The shuttle may be conveniently arranged so that it automatically positions the wires at the wire treatment stations, in both an axial and a lateral sense.

The apparatus may be constructed to produce harnesses comprising leads which are terminated at both ends to electrical connectors and may have means for automatically ejecting the finished harnesses from the apparatus.

For a better understanding of the present invention, an embodiment thereof will now be described by way of example with reference to the accompanying drawings in which;

FIG. 3 is a side view, shown partly in section, of a shuttle of the apparatus;

FIGS. 5A and 5B are enlarged side views of details of the apparatus illustrating the operation of the shuttle in relation to a wire template of the apparatus;

FIGS. 9A and 9B are schematic perspective views illustrating examples of electrical harnesses manufactured by means of the apparatus.

Figure 1:
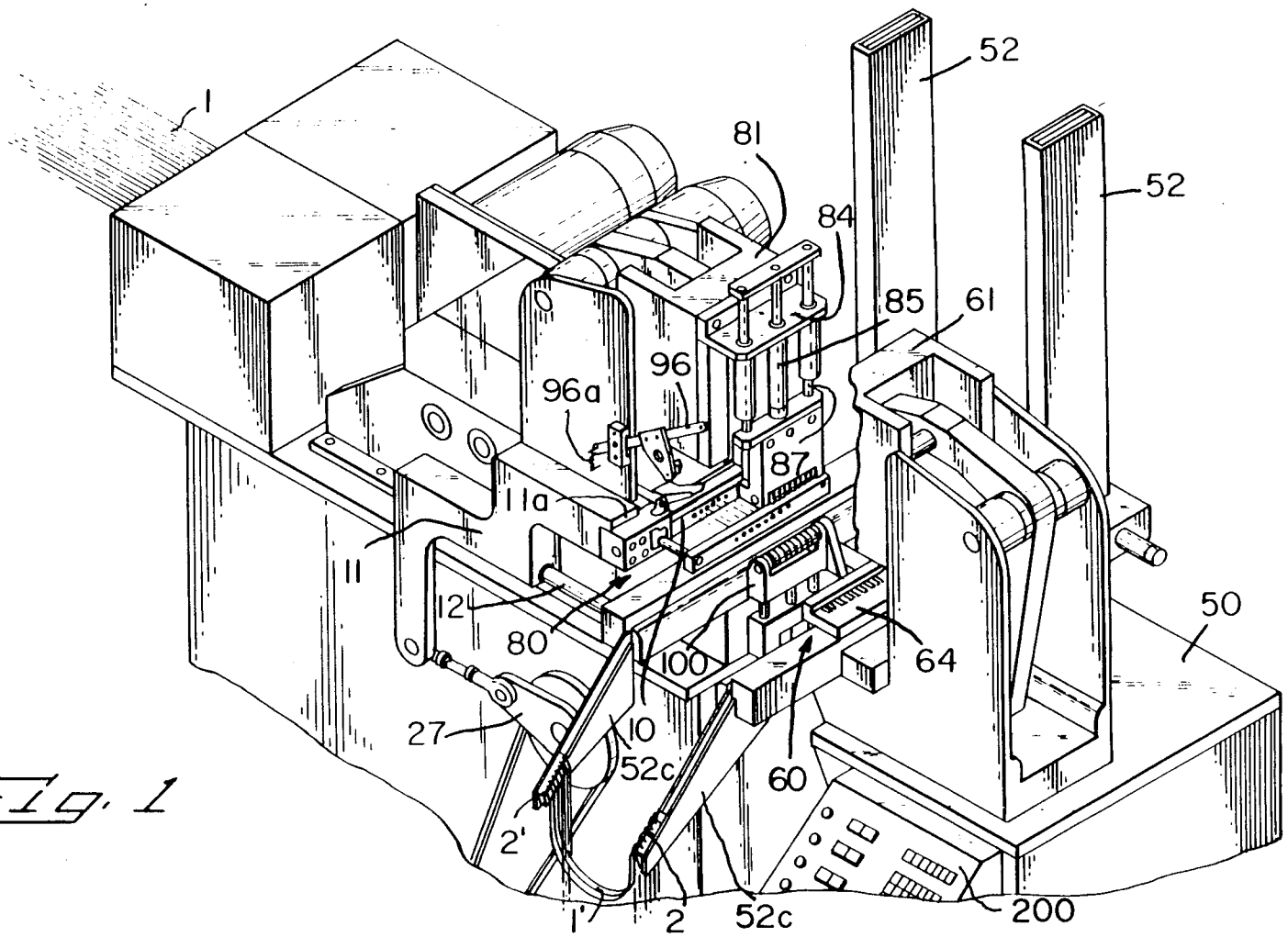
FIG. 1 is a perspective view, with parts removed, of wire processing apparatus for making a wiring harness having a plurality of wires of different lengths.
Figure 1A:
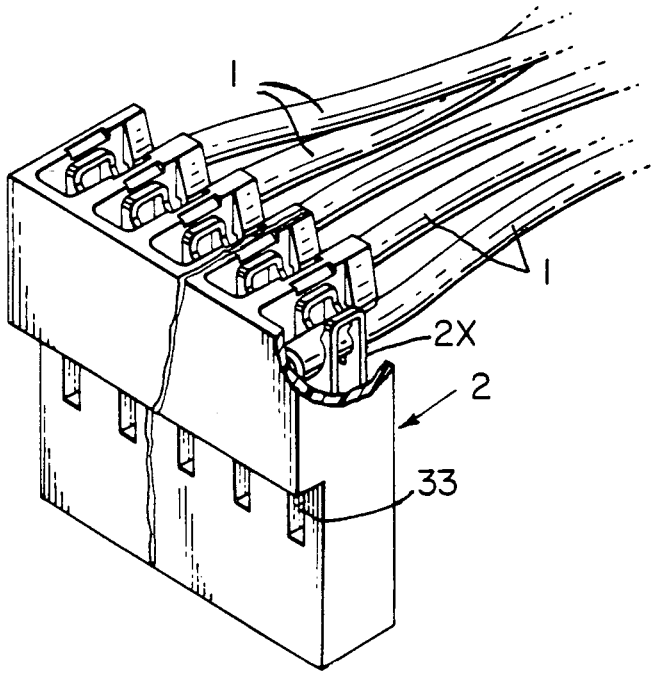
FIG. 1A is a perspective view of an electrical connector to which wires have been terminated.

FIG. 1A shows an electrical connector 2, for example, as described in U.S. Pat. No. 4,159,158 comprising an insulating housing containing electrical terminals 2x having wire slots into which insulated wires 1 can be forced so that the edges of the slots pierce the insulation of the wires to make electrical contact with the electrical conductive cores of the wires. The wires are inserted into the wire slots in a direction perpendicular to the longitudinal axes of the wires. The harness shown in FIG. 9A comprises two identical connectors 2 and 2', to which the respective ends of the leads 1' have been terminated. In the harness shown in FIG. 9B, the leads 1' are terminated to a common connector 2' at one end and to a plurality of smaller connectors **2*a* through 2*d* at their other ends. These smaller connectors are of the same construction as the connector 2**.

The harness making apparatus will now be described mainly with reference to FIGS. 1 through 5, when set up to manufacture the harness of FIG. 9A.

As shown in FIG. 1, the apparatus comprises a first wire treatment station 60, a second wire treatment station 80, both mounted on a base 50, and a wire shuttle 10 arranged to be driven horizontally in reciprocating motion between the stations 60 and 80.

At the station 60, the leading ends of wires 1 delivered thereto by the shuttle 10, which has been advanced from a starting position, are received and are forced into the wire slots of the terminals 2x of a connector 2, located at the station 60. At the station 80, the wires are severed to produce leads 1' and severed ends of these leads are forced into the wire slots of the terminals 2x of a connector 2' located at the station 80, after the shuttle 10 has been returned from the station 60 to its starting position and after the wires have been paid out, by means described below, to predetermined lengths.

Figure 2:
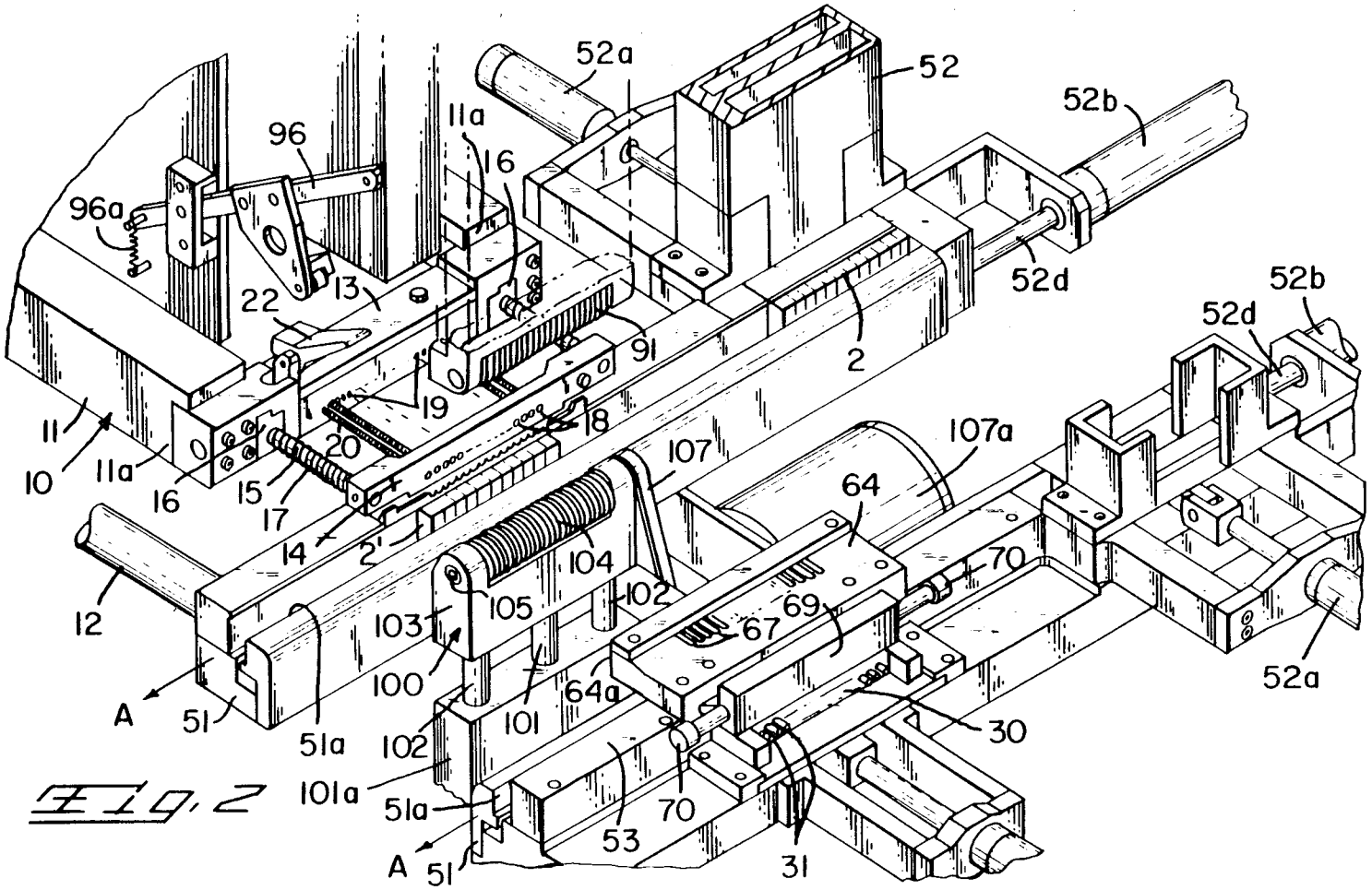
FIG. 2 is an enlarged perspective view of part of the apparatus.

The shuttle 10 comprises a pair of frame plates 11 (one of which is shown in FIG. 1), each of which is slideable along a horizontal guide rod 12, the rods 12 extending in parallel relationship over the base 50. An elongate wire clamp 13 is secured at each end, to the free end 11*a* of one of the frame plates 11, as best seen in FIG. 2. The shuttle also comprises an elongate header 14 each end of which is secured to a respective shaft 15, the shafts 15 which are parallel, each extending slidably through a respective hole in an oscillatory block 16 fitted into the wire clamp 13. The blocks 16 are movably mounted in the wire clamp 13 to permit the header 14 to be swung to a small extent vertically with respect to the clamp 13. The other ends of the shafts 15, which project from the rear side (as seen in FIG. 2) of the clamp 13, are enlarged so that the shafts 15 cannot be withdrawn from the blocks 16, compression springs 17 on the shafts 15 urging the header 14 away from the wire clamp 13. The header 14 and the wire clamp 13 are each formed with a row of holes 18 and 19, respectively, each receiving an insulated wire 1 extending from a wire source WS (FIG. 8A), the holes of each row being equidistant and extending parallel to one another and each hole 18 being in alignment with a corresponding hole 19. Lodged in each pair of aligned holes 18 and 19, is a tension coil spring 20, the tensile force generated by the springs 20 being smaller than the compressive force generated by the springs 17.

As shown in FIG. 3, the wire clamp 13 contains a leaf spring 21. A first lever 22 pivoted to the wire clamp 13 on a pin 23 bears a roller 25 engageable with a plate 26 to which the spring 21 is secured, the plate 26 being urged upwardly (as seen in FIG. 3) by a spring 26*a*. When the lever 22 is in the position in which it is shown in FIG. 3, the roller 25 depresses the plate 26 so that the spring 21 urges the wires 1 down into a longitudinal groove 24 in the wire clamp 13 whereby they are firmly secured thereto. The lever 22 can be rotated in a clockwise (as seen in FIG. 3) sense to cause the roller 25 to release the plate 26, thereby to release the spring 21 from the wires 1. The spring 21 can again be caused to clamp the wires 1 by urging a second lever 27 projecting from the lever 22, in a anticlockwise (as seen in FIG. 3) sense.

Figure 4A:
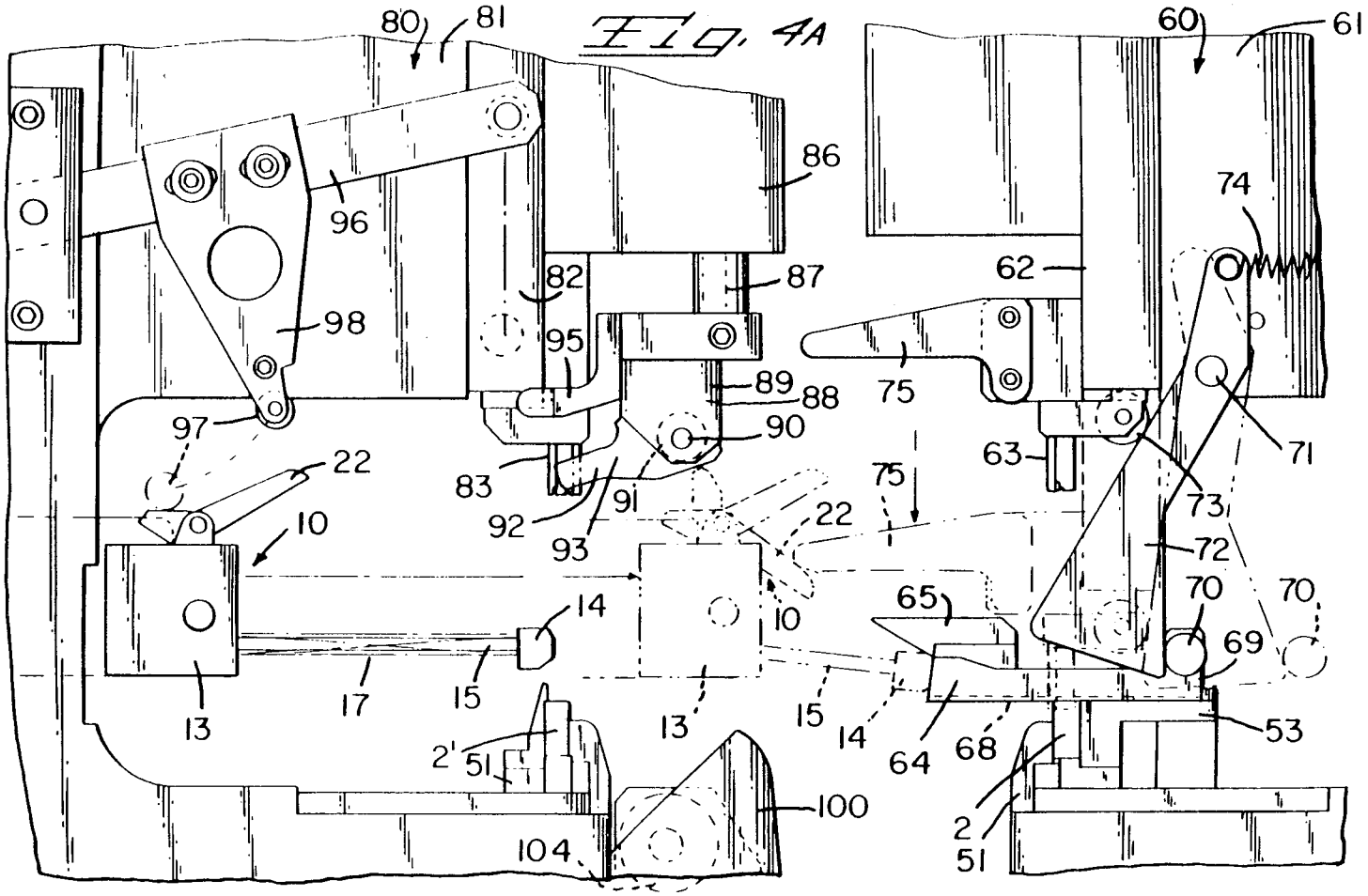
FIGS. 4A and 4B are enlarged side views of details of the apparatus, illustrating the operation of the shuttle in relation to first and second wire treatment stations of the apparatus.

In FIGS. 1 and 2, the shuttle 10 is shown in a retracted position near the second wire treatment station 80. The shuttle 10 can be advanced to the first wire treatment station 60 and returned to its retracted position, along the guide rods 12 by actuating a shuttle drive mechanism 27. The shuttle 10 is shown in its advanced position in broken lines in FIG. 4A. Just before the shuttle 10 reaches its advanced position, the header 14 thereof is biased downwardly by a cam plate 65 on a template 64 at the station 60, so as to engage a forward face of the template 64 as shown in FIG. 4A, whereby the shafts 15 are retracted through the blocks 16 against the action of the springs 17. The free end portions of the wires 1 are thereby advanced into the template 64 as will be described below.

Figure 4B:
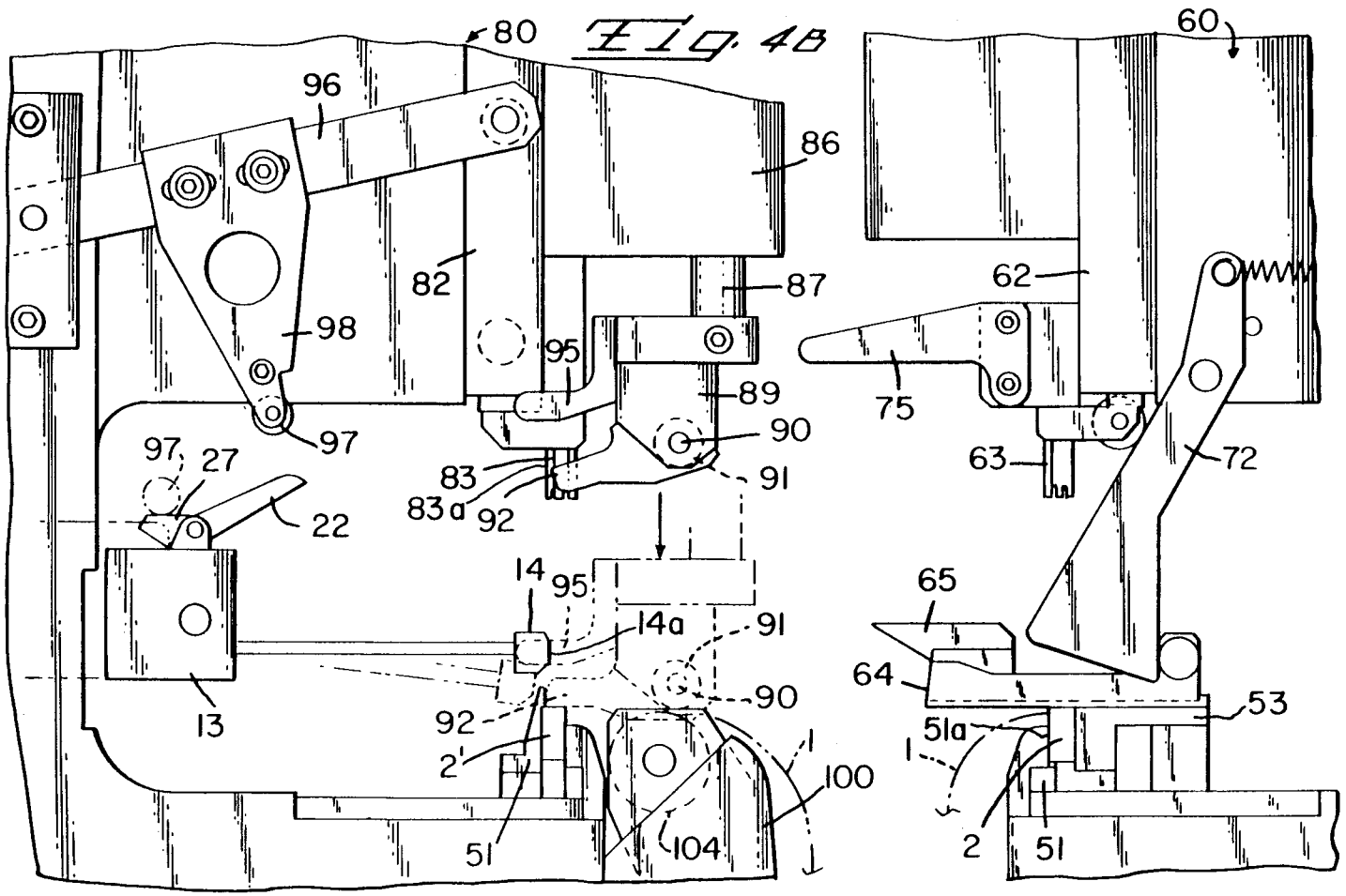

The stations 60 and 80 are provided with presses 61 and 81, respectively, having wire insertion blades 63 and 83, respectively, as shown in FIGS. 4A and 4B, secured to rams 62 and 82, respectively, of the presses 61 and 81. The rams are arranged to be driven in vertical reciprocating motion by conventional drive means not shown, to insert the wires into the wire receiving slots of the terminals 2x of connectors positioned below the blades 63 and 83, as described below, thereby to terminate the wires to the terminals. Beneath each set of blades 63 and 83 is a connector locating guide channel member 51 (best seen in FIG. 2) defining a connector guide channel 51*a* extending in a direction perpendicularly to the path of movement of the shuttle 10 and being fed with connectors 2 or 2' from a vertical connector magazine 52 by means of a piston and cylinder unit 52*a*. Each connector supplied to the channel 51*a* is fed there along by means of a further piston and cylinder unit 52*b* having a piston rod 52*d* to a position beneath the blades 63 or 83, as the case may be, prior to each wire terminating operation. After such operation, each wired connector 2 and 2' is discharged from its channel 51*a* in the direction of the arrow A in FIG. 2, by means of the unit 52*b* and falls down a chute 52*c* as shown in FIG. 1.

The template 64 carrying the cam plate 65 is mounted as best seen in FIGS. 4A and 4B on a support 53 so as to extend above the channel 51*a* at the station 60 and has a plurality of parallel wire guide channels 66, one of which is shown in FIGS. 5A and 5B, which opens forwardly of the template and which are spaced in accordance with the spacing of the terminals 2x of the connectors to which the wires 1 are to be terminated at the station 60. The template 64 is exchangeable to allow for connectors having terminals of different pitch to be connected to wires at the station 60. Each wire guide channel 66 communicates with slots 67 in the top, and slots 67' in bottom, thereof. The slots 67 extend from the forward face 64*a* of the template 64 substantially up to the center of its width as best seen in FIG. 2, the slots 67 in its bottom face, extending throughout its full width. A bottom plate 68 of the template 64 is slideable with respect thereto from the position seen in FIG. 5A to that shown in FIG. 5B. The plate 68 is normally urged towards the station 80, that is to say leftwardly as seen in FIGS. 5A and 5B by a spring 68*a* so as normally to close the slots 67' in the bottom surface of the template 64 as shown in FIG. 5A. Thus, when the free end portions of the wires 1 are fed by the shuttle 10 into the channels 66 as shown in FIG. 5A, the free end portion of each wire 1 is supported above the connector 2 at the station 60 by means of the plate 68. The plate 68 has, as its rear, or rightward end, as seen in FIGS. 5A and 5B, a rear wall 69 from opposite sides of which extend posts 70 as best seen in FIG. 2. Levers 72 mounted on opposite sides of the press 61, on a shaft 71 engage the respective posts 70. The ram 62 of the press 61 has thereon a roller 73 which descends and rises therewith. As the ram descends through its working stroke the roller 73 urges the levers 72 in an anticlockwise (as seen in FIGS. 5A and 5B) sense against the action of springs 74, attached to the press 61, so that the bottom plate 68 is slid rightwardly from its FIG. 5A to its FIG. 5B position so that the free end portions of the wires 1 resting on the plate 68 drop onto the connector 2 at the station 60 to enter the mouths of the wire receiving slots of the terminals 2x of the connector 2. During the descent of the ram 62 the wire insertion blades 63, each move through a respective opposed pair of the slots 67 and 67' in the template 64 to press the free end portions of the wires 1 fully home into the wire receiving slots (FIG. 5B). The ram 62 then rises through a return stroke to its FIG. 5A top dead center position and the levers 72 are returned to their FIG. 5A positions by the springs 74 whereby the plate 68 is returned to its closure position by the spring 68*a*. During the descent of the ram 62, a wire clamp releasing lever 75 attached thereto engages the lever 22 of the wire clamp 14, as illustrated in broken lines in FIG. 4A so that the later is swung to release the wires from the wire clamp 13.

Figure 6:
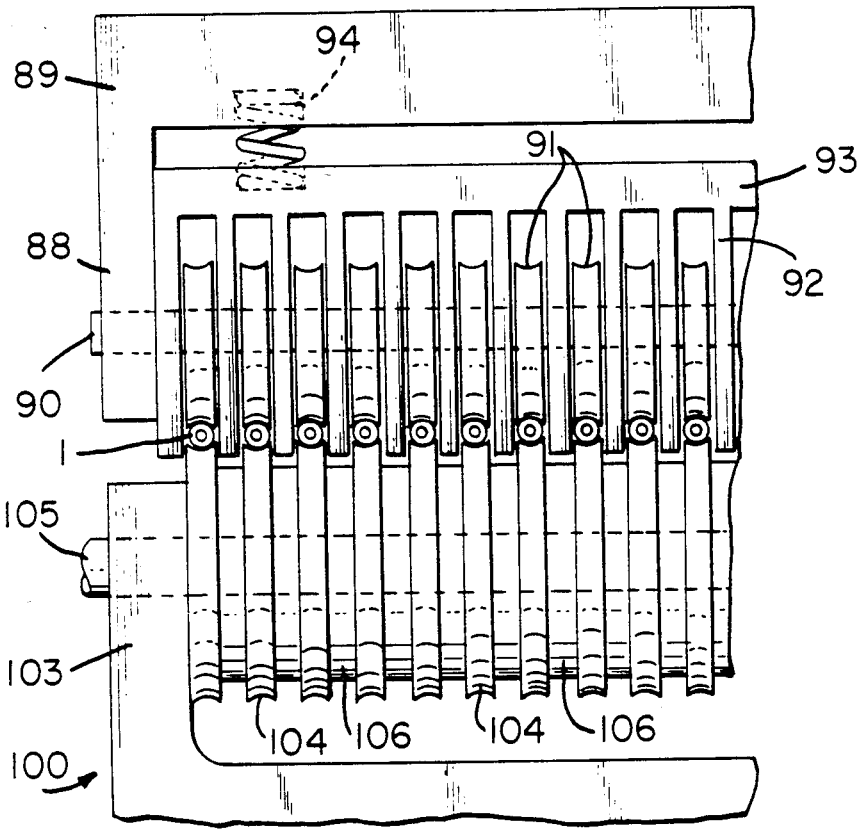
FIG. 6 is a view shown partly in section, illustrating the operation of pre-feed rollers and idle rollers of the apparatus.

As shown in FIG. 1, vertical piston and cylinder units having piston rods 87 are attached by a plate 84 to the press 81 at the station 80, these units are enclosed by a cover 86 as shown in FIGS. 4A and 4B. As best seen in these Figures, the piston rods 87 carry a roller holder 89 which is moved by the units 85 independently of the rod 82 of the press 81. The roller holder 89 carries a plurality of idle rollers 91 on a shaft 90 supported by side walls 88 of the holder 89, as best seen in FIG. 6. The rollers 91 are spaced from one another along the shaft 90 at distances corresponding to the pitch of the terminals 2x of the connector 2' to which wires are to be connected at the station 80. Also mounted on the shaft 90, is a pivotable wire guiding comb 93 having a wire guiding tines 92. The comb 93 is urged by a spring 94 (FIG. 6) acting between the comb 93 and the holder 89, so that the tines 92 normally extend between the wire insertion blades 83 of the ram 82. When the units 85 are actuated to move the piston rods 87 downwardly, the free end portion of each tine 92 enters between a pair of the wires 1 which extend from the shuttle 10 in its retracted position, that is to say its full line position in FIGS. 4A and 4B, and through the station 80 to the station 60. Each wire is thereby guided under the corresponding roller 91, between a pair of the tines 92. As the rods 87 reach their lowermost position, the tines 92 engage the connector 2 at the station 80, as shown in broken lines in FIG. 4B and are thereby rotated slightly, to assume a horizontal position. An arm 95 fixed to the holder 89 above the comb engages the header 14 of the shuttle 10 as the rods 87 descend, to deflect the header 14 slightly downwardly as illustrated in broken lines in FIG. 4B, so that each wire is positioned in the mouth of a wire receiving slot of a terminal 2x of the connector 2' at the station 80 and is forced into the slot by the blades 83 as the ram 82 completes its working stroke. At the same time, the wires are severed by a severing blade 83*a* fixed to the insertion blades 83, which passes across the leading face 14*a* of the header 14.

Below the idle rollers 91, is a pre-feed roller unit 100, (best shown in FIGS. 2 and 6) which is arranged for vertical reciprocating movement by the piston rod 101 of a piston and cylinder unit, and is guided by guide rods 102 mounted in cylinder block 101*a*. The unit 100 comprises a frame 103 in which are mounted pre-feed rollers 104 formed integrally with bearing rolls 106 rotatably supported by a shaft 105 in the frame 103. Each roller 104 is of the same thickness as the corresponding idle roller 91 and is arranged opposite thereto. The shaft 105 is driven in rotation through a belt 107 (FIG. 2) connected to a drive motor 107*a*. When the unit 100 is in a raised position, each roller 104 engages a wire 1 between itself and the corresponding roller 91, the wires extending between the tines 92 as shown in FIG. 6 and being guided thereby.

Figure 7:
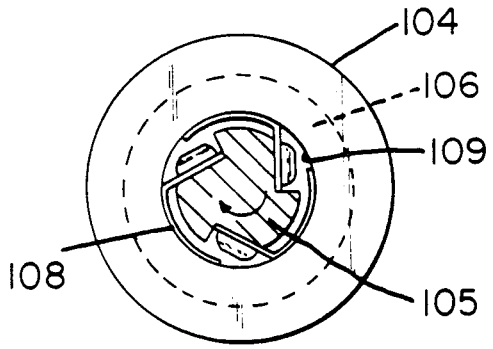
FIG. 7 is a side view, shown partly in section, illustrating the structure of one of the pre-feed rollers.

As shown in FIG. 7, three leaf springs 108, which are curved in the direction of rotation of the shaft 105, are attached to its periphery within each roller 104 and frictionally engage the inner annular surface 109 thereof. When the shaft 105 is driven through the belt 107, each roller 104 rotates with the shaft 105 so long as the roller 104 is unloaded. However, when the roller 104 is loaded, the leaf springs 108 slip on the surface 109 so that the roller 104 no longer rotates with the shaft 105. The idle rollers 91 and the pre-feed rollers 104 are closed towards one another by lowering the former and raising the unit 100 so as to engage the wires 1 between the rollers 91 and 104, when the shuttle 10 has been returned to its retracted position after the wires have been terminated at the station 60. A lever 96 loaded by a spring 96*a* (FIG. 1) and pivoted at one end to the ram 82 and at the other end to the press 81 carries a support 98 at the lower (as seen in FIGS. 4A and 4B) end of which is a roller 97. As the ram 82 carries out its working stroke, the roller 97 engages the lever 22 of the wire clamp 13, in the retracted position of the shuttle 10, to cause the wires 1 to be clamped.

Wire feed means 54 (which is conventional) shown in FIGS. 8A to 8F consists of a capstan 55 about which each wire 1, which extends from the wire source WS (FIG. 8A), has been wound by a single turn, guide rollers 56, a wire clamp 57, and intermittently driven wire lengthening rollers 58 and cooperating idle rollers 59, a pair of rollers for each wire, which are arranged to pay out the wires to different predetermined lengths. The capstan 55 is continuously rotated, but will not pull a wire from the wire source unless the part of the wire downstream thereof is in a taught condition so that the capstan 55 is loaded. The clamp 57 can be moved towards the rollers 56 to clamp the wires and the rollers 58 can be moved towards the rollers 59 to drive the wires. A set of idle rollers 91*a* (FIGS. 8A to 8F) may be provided for supporting the wires between the rollers 91, 104 and the connector 2 at the station 60.

The means for driving all the parts described in the foregoing are controlled to operate in their correct sequence by means of an electronic control unit 200 (FIG. 1).

The operation of the apparatus will now be described mainly with reference to FIGS. 8A through 8F which illustrate consecutive steps in an operating cycle of the apparatus.

Figure 8A:
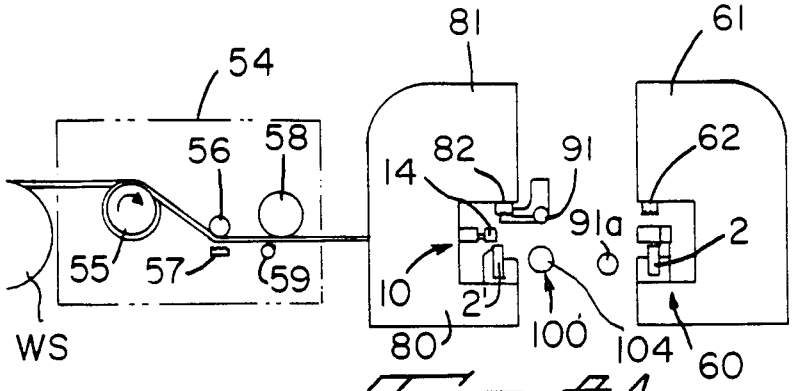
FIGS. 8A to 8F are diagrams illustrating respective stages in a cycle of operation of the apparatus.

At the beginning of the operating cycle, as shown in FIG. 8A, the leading end of each wire 1 which has been fed into the wire clamp 13, is firmly held thereby and extends into the header 14 (also see FIG. 3). The shuttle 10 is in its initial retracted position at the station 80, the roller unit 100 being in its lowered position, the idle rollers 91 being raised, the rams 62 and 82 being in their top dead center positions, the clamp 57 being in a retracted position away from the rollers 56 and connectors 2 and 2' being disposed in the channels 51*a* below and opposite to, their corresponding insertion blades 63 and 83, respectively.

The wire lengthening rollers 58 are in a raised position in which they do not cooperate with the idle rollers 59 to drive the wire and the shuttle 10 is stationary so that the capstan 55 is not loaded so as to pull the wires 1 from the wire source WS.

Figure 8B:
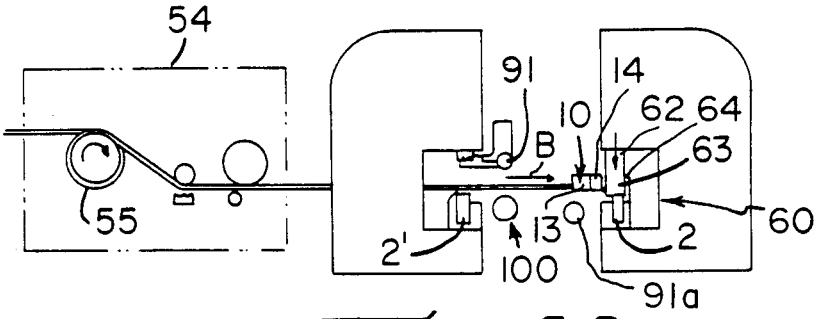

As shown in FIG. 8B, the shuttle 10 has been moved along the wire feed path, indicated by the arrow B, from its retracted position, to the station 60, by the operation of the shuttle drive means 27 (FIG. 1) so that the header 14 having engaged the template 64, as described above, the leading end portions of the wires 1 extend from the header 14 and are supported by the plate 68 of the template 64. The ram 62 has performed its working stroke to terminate the leading ends of the wires 1 to the terminals 2x (FIG. 1A) of the connector 2 at the station 60. These positions of the shuttle 10 and ram 62 are those shown in broken lines in FIG. 4A. Also as shown in that Figure, the lever 22 of the wire clamp 13 has been rotated by the arm 75 so that the wire clamp 13 has released the wires. As the shuttle 10 is moved from its FIG. 8A position to its FIG. 8B position, the wires downstream of the capstan 55 are tensioned so as to load the latter, so that the capstan 55 feeds wires 1 from the wire source in the downstream direction of the capstan 55 by the length of travel of the shuttle.

Figure 8C:
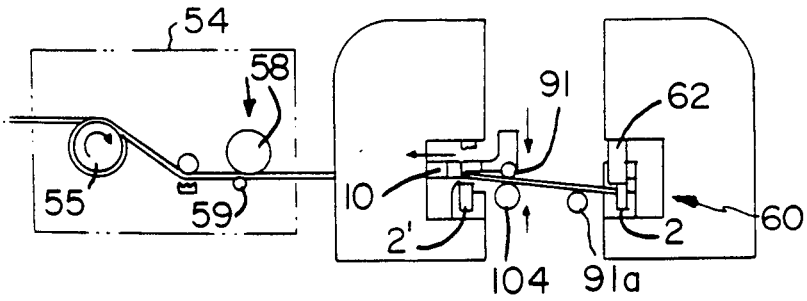

As shown in FIG. 8C, the shuttle 10 is then returned to its retracted, initial position, along the wires 1, the leading ends of which are fixed, by virtue of their termination to the connector 2 at the station 60, the wires being tensioned between the capstan 55 and the connector 2. The rollers 58 are now depressed towards the rollers 59 so that the wires are engaged between the rollers 58 and 59 and the rollers 91 and 104 are also moved towards one another to engage the wires. The press ram 62 at the station 60 remains in its lowermost position.

Figure 8D:
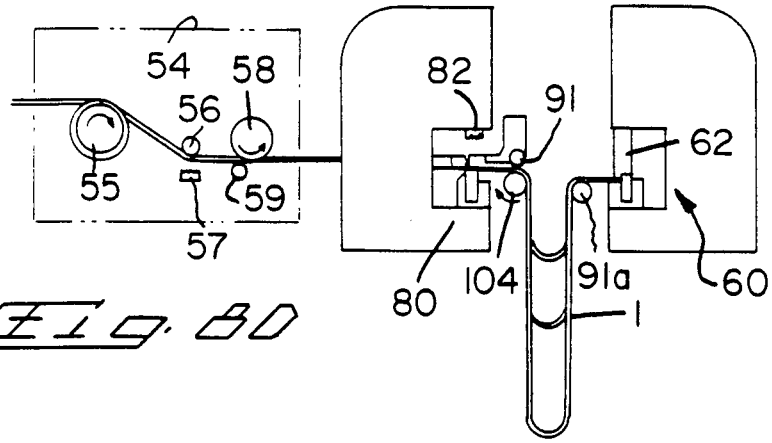

The lengthening rollers 58 are now operated as indicated in FIG. 8D to feed each wire by a predetermined length, towards the rollers 91 and 104, each roller 104 being operated at the same time as the rollers 58 and 59, to pull the wire fed thereby and pay out the wire in the form of a loop which is supported between the rollers 104 and 91*a*, between the stations 60 and 80. The rollers 104 and 91 continue to rotate whilst the rollers 58 and 59 are paying out the wires by predetermined lengths, the rollers 91 and 104 thereby functioning always to maintain tension on each wire as it is payed out by the corresponding rollers 58 and 59. The rollers 58 and 59 are stopped after the wire has been payed out to the predetermined length, each roller 104 being thereby relieved of load so that its rotation ceases and it therefore no longer drives the wire (as described with reference to FIG. 7).

Figure 8E:
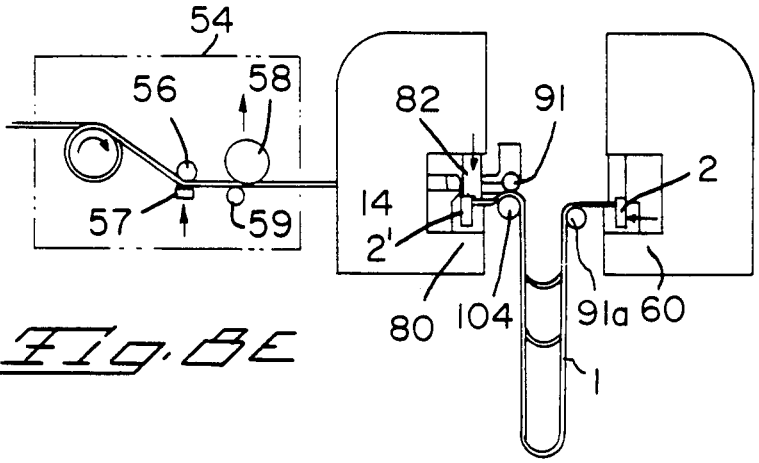

As shown in FIG. 8E, the clamp 57 is moved towards the rollers 56 so that the wires are firmly clamped there between. The rollers 58 are then raised to their initial position. The press ram 82 at the station 80 is now driven through a working stroke so that the blades 83 thereon insert the wires between the header 14 and the rollers 91 and 104 into their respective terminals 2x of the connector 2' at the station 80, the wires being simultaneously severed between the blade 83*a* and the leading face 14*a* of the header 14 so that the leads 1' are left attached to the connectors 2 and 2'. As the ram 82 descends, the lever 96 is swung down so that the roller 97 on the support 98 thereof engages and swings the lever 27 of the wire clamp 13 in an anticlockwise direction (as seen in FIGS. 4A and 4B) so that the wires are again clamped in the wire clamp 13.

Figure 8F:
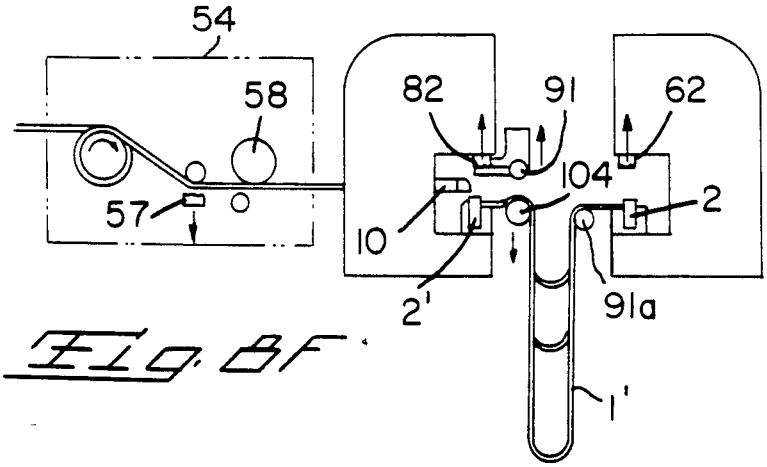

As shown in FIG. 8F, the rams 67 and 82 are now returned to their top dead center positions and simultaneously, the rollers 91 and 104 are moved apart and the wire clamp 57 is moved away from the roller 56. The connectors 2 and 2' which are now interconnected by leads, are then discharged from the apparatus via the chutes 52*c*, as shown in FIG. 1.

The apparatus may be provided with a continuity tester arranged automatically to determine whether each lead 1' has been securely electrically connected to its terminals at the stations 60 and 80. A continuity test probe unit 30, which is shown in FIG. 2, positioned behind the template 64 at the station 60 comprises a plurality of contact probe pins 31 each adapted to be axially moved through an opening 43 (FIG. 1A) in the connector 2 at the station 60 and into contact with a terminal 2x thereof. Each pin 31 is electrically connected to a corresponding pin of a similar continuity test probe unit (not shown) arranged behind the connector 2' at the station 80 and is further connected to the control device 200. If each lead is electrically connected to its corresponding terminals in the connectors, a circuit is closed between the terminals of these two connectors and a success signal is displayed by the control device at 200. In the event that electrical continuity is not achieved, the control device 200 operates to stop the apparatus.

In the manufacture of the harness shown in FIG. 9B, connectors 2' are arranged in the magazine 52 of the station 80 and connectors 2*a* and 2*d* in the magazine of the station 60.

We claim:

1. Wire processing apparatus comprising a base, first and second stations arranged in spaced relationship on the base, a wire delivery shuttle for conveying a plurality of wires in juxtaposed relationship along a wire feed path, through the second station to the first station, means for then securing the wires at the first station, means for driving the shuttle in reciprocating motion along said path to deliver the wires to said stations, means for feeding wires from a wire source for delivery by the shuttle and wire lengthening means disposed upstream of the second station and being actuable to advance the wires longitudinally thereof relative to the shuttle when the wires have been secured at the first station and the shuttle has been retracted from the first station, so that the wires form loops of different lengths between the first and the second stations; wherein wire tensioning rollers comprising a first set of idle rollers and a second set of driven rollers disposed opposite thereto which can be closed about the wires to drive them are disposed downstream of the second station, for paying out the wires as they are advanced by the wire lengthening means so as to tension the wires between the wire tensioning rollers and the wire lengthening means.

2. Apparatus according to claim 1, comprising, drive means for the rollers of the second set, slip clutch means interposed between the rollers of the second set and the drive means and means for closing the sets of rollers about the wires, simultaneously with the actuation of the wire lengthening means.

3. Apparatus according to claim 2, wherein each set of rollers comprises a roller for each wire, a wire guiding member being provided between each pair of adjacent rollers of the first set, for interposition between two adjacent wires as the sets of rollers are closed about the wires, to guide each wire between an opposed pair of the rollers.

4. Apparatus according to claim 1, wherein the shuttle comprises a wire clamp and a header connected to the wire clamp by coil springs through which the wires pass so that leading ends thereof extend through passages in the header, a fixed abutment of the first station for compressing the springs by engagement with the header to cause the leading end portions of the wires to project from the header into the first station, and a cam plate fixed at the first station to guide the header into engagement with the abutment.

5. Apparatus according to claim 4, wherein a wire insertion ram is provided at the second station and the coil springs are supported by rods which are retractable towards the wire clamp against the action of the springs and are deflectable with respect to the wire clamp, abutment means which are movable independently of the ram being provided at the second station for deflecting the header with respect to the wire clamp to locate the leading end portions of the wire at said second station.

6. Apparatus according to claim 5, wherein the first station comprises a further ram inserting the leading end portions of the wires into terminals of an electrical connector at the first station and a template for guiding the leading end portions into the terminals, the template having a bottom slide upon which the leading end portions are laid by virtue of the deflection of the header, means being provided on said further ram for displacing the bottom slide to allow the leading end portions to be inserted into the terminals as the ram moves through its working stroke, a wire comb being moveable with said abutment means to guide the wires into the second station.

7. Apparatus according to claim 1, wherein the shuttle comprises a wire clamp having a clamping member which is moveable by means of a first lever thereon to clamp the wires to the wire clamp and which is moveable by means of a second lever projecting from the first lever and being fixed relative thereto, to release the wires from the wire clamp, means being provided at the second station for engaging the first lever to rotate it in a first sense to clamp the wire, and means being provided at the first station for engaging the second lever to rotate the first lever in a second and opposite sense to release the wires so as to allow the shuttle to be moved therealong from the first station to the second station.

8. Wire processing apparatus comprising a base, first and second wire treatment stations arranged in spaced relationship on the base, a wire delivery shuttle for conveying a plurality of wires in juxtaposed relationship along a wire feed path, through the second wire treatment station to the first wire treatment station, means for then securing the wires at the first wire treatment station, means for driving the shuttle in reciprocating motion along said path to deliver the wires to said wire treatment stations, a wire feed roller for feeding wires from a wire source for delivery by the shuttle, intermittently driven wire lengthening rollers disposed upstream of the second wire treatment station and downstream of the wire feed roller and being actuable to advance the wires longitudinally thereof relative to the shuttle when the wires have been secured at the first wire treatment station and the shuttle has been retracted therefrom, so that the wires form loops of different lengths between the first and the second wire treatment stations, wire tensioning rollers comprising a first set of idle rollers and a second set of driven rollers disposed opposite thereto which can be closed about the wires to drive them, disposed downstream of the second wire treatment station for paying out the wires as they are advanced by the wire lengthening rollers so as to tension the wires between the wire tensioning rollers and the wire lengthening rollers and means for closing the wire tensioning rollers about the wires simultaneously with the actuation of the wire lengthening rollers.

* * * * *